United States Patent [19]

Adams

[11] 4,057,024

[45] Nov. 8, 1977

[54] RELEASABLE ANCHOR

[75] Inventor: Truman W. Adams, Indianapolis, Ind.

[73] Assignee: Indianapolis Center For Advanced Research, Indianapolis, Ind.

[21] Appl. No.: 619,778

[22] Filed: Oct. 6, 1975

Related U.S. Application Data

[63] Continuation-in-part of Ser. No. 535,953, Dec. 23, 1974, abandoned.

[51] Int. Cl.[2] ..... B63B 21/44

[52] U.S. Cl. ..... 114/298; 114/305

[58] Field of Search ..... 114/293, 294, 297–299, 114/301–310

[56] References Cited

U.S. PATENT DOCUMENTS

| | | | |
|---|---|---|---|
| 1,782,449 | 11/1930 | Siebert | 114/208 A |
| 2,012,751 | 8/1935 | Buch et al. | 114/208 A |
| 2,851,983 | 9/1958 | Hrivnyak | 114/208 A |
| 2,985,132 | 5/1961 | Detrick | 114/208 A |

*Primary Examiner*—Trygve M. Blix
*Assistant Examiner*—Stuart M. Goldstein
*Attorney, Agent, or Firm*—Woodard, Weikart, Emhardt & Naughton

[57] ABSTRACT

An anchor incorporating an arrangement for releasing the anchor when it becomes snagged on large rocks or other objects. One embodiment includes a blocking element which is positioned in the elongated anchor body to prevent the anchor arms from moving out of a radially extending position to a position in which they extend longitudinally of the body. The blocking element is spring biased into its blocking position and has a sleeve thereon which is also spring biased to a position wherein the sleeve holds the anchor arms away from the blocking element. A sharp jerk on the anchor line causes the blocking element to move in the elongated anchor body out of blocking position releasing the anchor. Another embodiment includes a blocking element similarly positioned in an elongated anchor body. A striker element is mounted on the anchor body and connected to the anchor line and is spring biased to a position spaced from the blocking element. A sharp jerk on the anchor line causes the striker element to strike the blocking element to drive it out of blocking position releasing the anchor. A further embodiment of the invention releases the anchor by a pull of predetermined amount.

9 Claims, 18 Drawing Figures

RELEASABLE ANCHOR

CROSS REFERENCE TO RELATED APPLICATION

This is a continuation-in-part application of my patent application Ser. No. 535,953, filed Dec. 23, 1974 now abandoned.

BACKGROUND OF THE INVENTION

1. Field of the Invention

This invention relates to an anchor having releasable arms.

2. Description of the Prior Art

Various types of anchors are available in the prior art such as those illustrated in the following patents: U.S. Pat. No. 3,123,037 issued to I. J. Jensen; U.S. Pat. No. 3,283,736 issued to H. G. Williams; U.S. Pat. No. 3,138,134 issued to J. E. Botine; U.S. Pat. No. 1,782,449 issued to W. Siebert; U.S. Pat. No. 3,747,553 issued to R. K. Riddle, Sr.; U.S. Pat. No. 3,397,665 issued to L. Lindly; U.S. Pat. No. 3,674,970 issued to C. F. Andrews; U.S. Pat. No. 2,012,751 issued to H. Buch et al; U.S. Pat. No. 2,851,983 issued to J. Hrivnyak; and U.S. Pat. No. 2,204,799 issued to C. W. Filby. The prior art devices incorporate various deficiencies. Many are not releasable when they become hooked or engaged on obstacles. Some of those that are releasable require additional trip lines which make the use and operation of the anchors inconvenient. Others of those that are releasable are complicated in construction and theory and are of doubtful operability.

SUMMARY OF THE INVENTION

One embodiment of the invention might involve a body and a plurality of arms pivotally mounted on the body and movable between two positions in a first of which the arms extend radially outwardly of the body and in a second of which the arms are pivoted out of the first position. A blocking element is received in the body in a blocking position so as to block the movement of the arms from the first position to the second position. The arms are movable, under the force of the arms engaging an object in anchoring relation, to a gripping position wherein said arms engage and grip said blocking element to hold it in said blocking position. There is also provided means for connecting the blocking element to an anchor line and means for yieldably holding the arms out of the gripping position whereby a sharp jerk on the anchor line can move the blocking element out of blocking position.

Objects of the invention are to provide an improved anchor, to provide an anchor which is easily releasable from a snagged condition by merely jerking the anchor line, to provide an anchor which is releasable even though the anchor has a relatively long anchor line, to provide an anchor which is dependable and simple in construction and operation, to provide an anchor which is releasable at a certain anchor line tension which can be adjusted, to provide an anchor which can be easily handled on deck, to provide an anchor which is easily stored, to provide an anchor which automatically resets itself when it is dropped away from a boat-mounted anchor receiver and which also automatically resets itself in other situations.

DESCRIPTION OF THE PREFERRED EMBODIMENT

Figure 1:
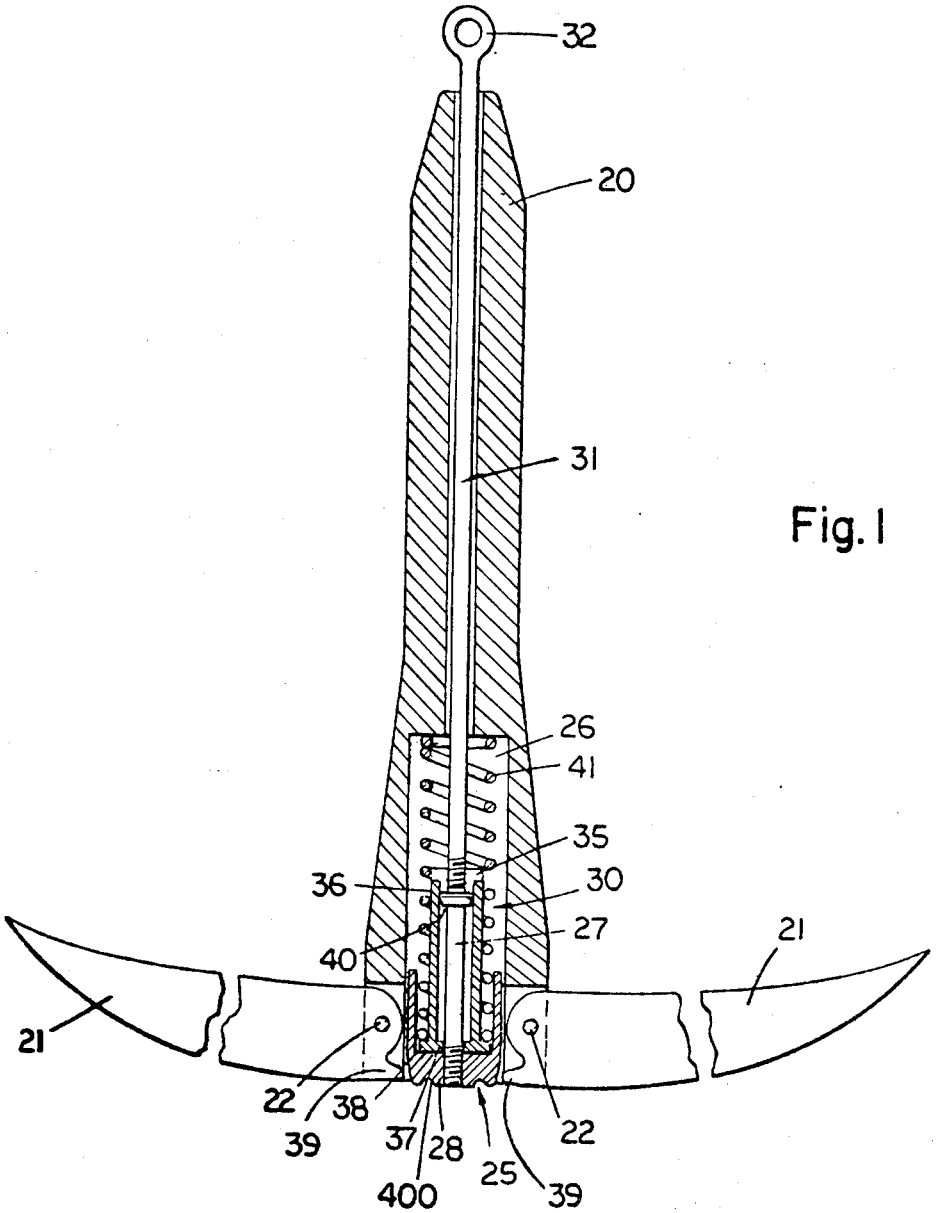
FIG. 1 is a section taken along the line 1—1 of FIG. 2 in the direction of the arrows and showing an anchor embodying the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
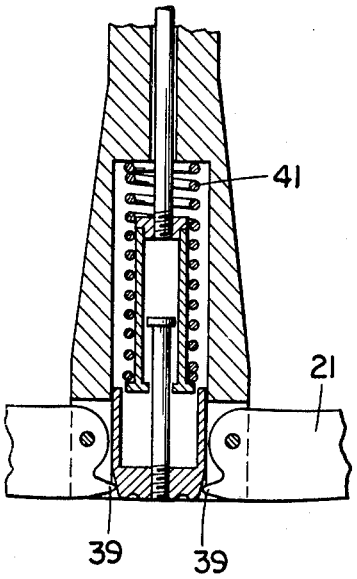
FIG. 3 is a section similar to the section of FIG. 1 but showing the anchor in a different operating position.
Figure 4:
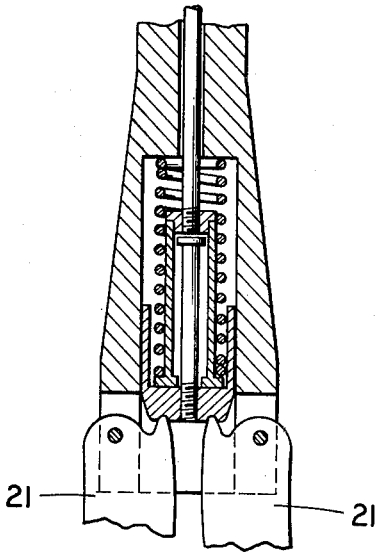
FIG. 4 is a section similar to FIGS. 1 and 3 but showing the anchor in still a further operating position.

Referring more particularly to FIG. 1, there is illustrated an anchor which includes an elongated body 20 having arms or flukes 21 pivotally mounted thereon by pins 22. In the position shown in FIGS. 1, 2 and 3, the arms 21 are extending radially outwardly of the body 20 and are in position to engage the ground or rocks for normal operation of the anchor to stop movement of the watercraft. In FIG. 4 the anchor arms 21 are shown in the position in which they are parallel to the length of the body 20, this position being the storage position of the anchor. The FIG. 4 storage position is only one of the released positions of the anchor.

A blocking element 25 is positioned within a cylindrical indentation or bore 26 in the lower end of the body 20. The blocking element 25 consists of a cup shaped member 28 and an anvil member 27 threadedly mounted on the cup shaped member 28. The blocking element 25 is limited against movement out of the indentation 26 by means of screws 29 which are threadedly mounted on the body 20 and whose heads extend in the path of the blocking element 25 preventing it from exiting completely from the indentation 26. A striker element 30 includes a rod 31 which extends longitudinally of the body 20 at the axis thereof and has a projecting end 32 proportioned for connection to an anchor line. The rod 31 is threadedly connected to a coupling member 35 which is also threadedly connected to striker member 36. The striker member 36 has an inwardly extending flange 37 and an outwardly extending flange 38. The inwardly extending flange 37 provides a striker surface for striking the anvil member 27 at the anvil surface 40. The outwardly extending flange 38 acts as a surface against which the coiled compression spring 41 is received. The coiled compression spring 41 also acts against the body 20, the spring 41 functioning to yieldably retain the striker element 30 in engagement with the cup shaped member 28 of the blocking element 25 and with the blocking element 25 in engagement with the screws 29 so as to hold the blocking element in a blocking position maintaining the arms 21 in a radially outwardly extending position.

Assuming now that the anchor is in the water and an anchor line is connected to the loop 32 and the anchor engages an obstacle, the pull on the anchor line may be sufficient to cause the rod 31 to move upwardly in the body 20 and cause the compression spring 41 to be compressed thereby pulling the striker element away from the cup shaped member 28. This force is, of course, transmitted through the tines 21, the body 20, the spring 41, the striker element 30 and the anchor line. The fact that the striker element is pulled away from the blocking element does not mean that the blocking element leaves the position illustrated in FIG. 1 because the flukes or arms 21 pivot against the blocking element so that the projections 39 on the flukes engage the blocking element 25 and grip it in the illustrated position of FIG. 1.

In one illustrative example embodiment of the invention the spring 41 was so chosen that it produced a force of 20 pounds against the body and the striker element when in the position of FIG. 1. As force is placed on the rod 31 tending to pull the rod 31 to the position of FIG. 3, the spring 41 is compressed and therefore exerts an increasingly greater force on the body and the striker element which upon reaching the position of FIG. 3 is approximately 30 to 35 pounds. When the flange 37 moves very close to the anvil 40 the force exerted by the spring 41 is approximately 40 pounds. Thus the force necessary to hold the flange 37 close to the anvil 40 is approximately 40 pounds on the anchor line or on the striker element 31. With 40 pounds acting on the striker element there is a much greater normal force or forces exerted on the blocking element 25 by means of the portions 39 of the arms 21. The amount of normal force is, of course, determined by the moment arm in each case about the axes of the respective pins 22. These greater normal forces, of course, produce substantial frictional forces which hold the blocking element in the position of FIG. 3 and prevent the arms 21 from going to the position illustrated in FIG. 4.

In the normal use of the anchor the force exerted on the anchor line may gradually increase so that it is greater than 40 pounds. When this occurs the flange 37 will engage the anvil 40 and exert an upward force thereon. For example, a 60 pound force on the anchor line and striker element will produce a 20 pound upward force on the blocking element 25. The blocking element, however, will remain gripped by the arms 21 because of the great force produced by the moment arm about the axes of pins 22.

If it is determined that the anchor is hung up because it cannot be pulled in, it is released by first releasing the tension in the anchor line followed by a quick jerk. This procedure initially causes a reduction or elimination of the gripping force on the blocking element 25 and also causes the striker element 30 to move downwardly to the position of FIG. 1 and then to strike the blocking element 27 causing engagement between the flange 37 and the surface 40 and driving the blocking element into the position of FIG. 4 releasing the flukes. This tripping action is facilitated by the inertia of the body 20 and the kinetic energy of striker element 30 as it strikes the anvil 40.

It has been determined that the anchor illustrated in FIGS. 1 through 4 works very well as long as the anchor line is not too long. It has been found that if the anchor line is too long, for example in one embodiment of the invention longer than 40 feet, the rope stretch in the anchor line was such as to absorb the jerk on the line because of the substantial force necessary to overcome the force of the spring 41. If the spring 41 is made weaker, the anchor will trip with a longer anchor line; however, the anchor will also sometimes trip by just dragging it over the ground which, of course, is undesirable. For these reasons, the embodiments illustrated in FIGS. 5, 6 and 7 have been designed to make the device workable with a longer anchor line.

Figure 5:
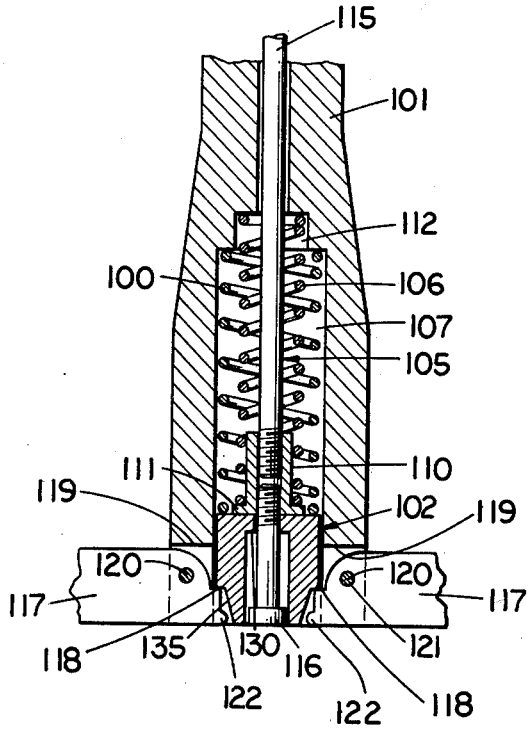
FIG. 5 is a section similar to FIG. 1 of an alternative embodiment of the present invention.

Referring to FIG. 5, the embodiment there illustrated is substantially similar to the embodiment of FIGS. 1–4 with the exception that an additional spring 100 is provided acting between the body 101 and the blocking element 102 at all times, even when the striker element 105 has been moved away from the blocking element 102 by depression of the spring 106.

The embodiment of FIG. 5 is very similar to that of FIG. 1 in that it includes an elongated body 101 and an indentation 107 within which the striker element 105 and the blocking element 102 are received. There is also provided a spring 106 which acts between the body 101 and the striker element 105 and specifically acts against an internally threaded connecting member 110 having a flange 111 at its lower end against which bears the lower end of the spring 106. The upper end of the spring 106 is received and seated within a reduced diameter portion 112 of the indentation 107. The striker element includes the coupling member 110 which couples together the rod 115 and the striker member 116. The arms or flukes 117 are pivoted about the axes 120 of the pins 121 and are locked in the radially extending illustrated position by engagement of the portions 122 of the arms 117 with the blocking element 102.

In the embodiment of FIG. 5 the screws 29 are replaced by the flat surfaces 118 on flukes 117 which flat surfaces limit the downward movement of the blocking element 102 in the position of FIG. 5. Also the surfaces 119 on the body 101 act as stops for the flukes 117 preventing them from pivoting upwardly past the position of FIG. 5.

Figure 5A:
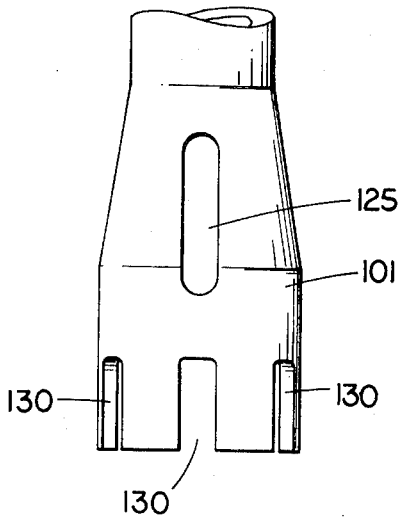
FIG. 5A is a side elevation of a portion of an alternative embodiment of the invention which is identical to the embodiment of FIG. 5 but which differs only in the part shown in FIG. 5A.

Referring to FIG. 5A, it has been found that the operation of the device of FIG. 5 is sometimes facilitated if slots 125 extending from the outside of the body 101 to the indentation 107 are provided in order to prevent a hydraulic ram effect. Another means, of course, of preventing such effect is to provide grooves extending along the blocking member 102 or along the indentation 107 so that water can easily move in and out of the indentation when the blocking element is moving in the indentation 107. It can be seen from FIG. 5A that at least in one embodiment of the invention the anchor of FIG. 5 is provided with six arms 117 instead of with four because of the fact that the slots 130 are located at 60° to one another. It should be noted that the slot 125 or slot similar to slot 125 can be provided in all of the embodiments of FIGS. 1–7.

In the embodiment of FIG. 5 the compression in the spring 106 when the device is in the position of FIG. 5 can be less than the compression in the spring 41 when the embodiment of FIG. 1 is in the position of FIG. 1. This is true because the additional spring 100 holds the blocking element 102 in position. Thus in one embodiment of the invention the compression in the spring 106 was approximately 5 pounds when the spring is in the position of FIG. 5. When the spring 106 is compressed to the point at which the striker member 116 contacts the blocking element 102, the compression in the spring 106 is approximately 15 pounds. The compression in the spring 100 when in the position of FIG. 5 is approximately 7 or 8 pounds.

Thus when the anchor of FIG. 5 is pulled with a steady pull on the anchor line so as to create a steady pull on the striker element 105 so that it is moved to a position wherein the spring 106 is compressed and the striker member 116 moves into engagement with the anvil surface 130 of the blocking element, there is at least 15 pounds upward pull on the striker element and blocking element. This pull is also exerted on the flukes or arms which are in engagement with an obstacle and is sufficient to give the flukes or arms 117 enough of a grip on the blocking element 102 that the anchor will not trip.

It should be noted that the lower portion 135 of the blocking element 102 has a tapered surface. The taper in this surface assists in causing the blocking element to be driven out of blocking position by the sharp rap which is given to the blocking element by the striker element. It has been found that too much such taper will cause the blocking element not to remain in blocking position when it is engaged by the arms 117 during the normal anchoring operation of the anchor. The exact amount of this taper, however, will vary depending on the other parameters of the anchor.

It has been found that the use of the two springs as in FIG. 5 assists in making the anchor releasable or trippable, even though there is a relatively long anchor line connecting the anchor to the boat. Thus, with the various parameters in spring rates and preset forces as set forth above in the specific example of the anchor of FIG. 5, it has been found that the anchor will easily trip at 100 feet by jerking the line and also will not trip with the relatively constant pull such as is exerted during a normal anchoring operation and also will not trip when the anchor is dragged over the ground.

Figure 6:
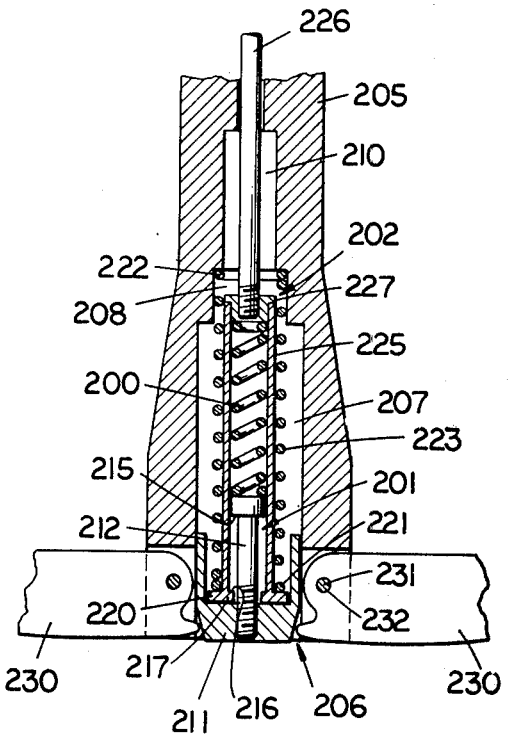
FIG. 6 is a view similar to FIG. 1 of a further alternative embodiment of the invention.

Referring now to FIG. 6, a further embodiment of the invention is illustrated which is very similar to the embodiment of FIG. 5 but in which the spring 100 is replaced by a spring 200 which acts between the blocking element 201 and the striker element 202. The elongated body 205 of the anchor has formed therein an indentation 206 which includes a larger diameter portion 207, intermediate diameter portion 208 and a reduced diameter portion 210. The blocking element 201 includes a cup shaped member 211 and the anvil member 212 threadedly connected thereto. The anvil member 212 has an anvil surface 215 which is struck by the striker surface 216 on the inwardly projecting flange 217 of the striker element. The outwardly projecting flange 220 of the striker element has the lower end 221 of compression spring 223 acting thereagainst with the opposite end 222 of the compression spring being received in the intermediate diameter portion 208 of the indentation 206.

Figure 2:
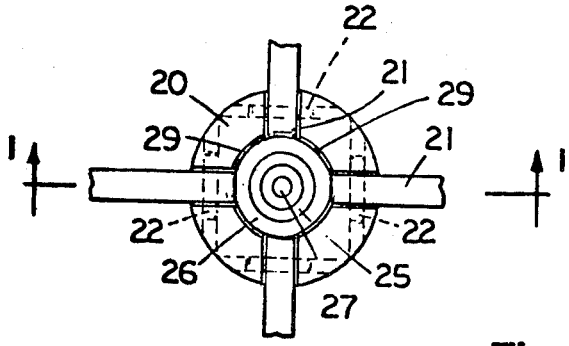
FIG. 2 is a fragmentary bottom plan view of the anchor of FIG. 1.

The striker element 202 includes the striker member 225 with its flanges 220 and 217 and a rod 226 which is coupled to the striker member 225 by internally and externally threaded connecting member 227. The anchor flukes or arms 230 are pivotally mounted about the axes 231 of pins 232 in the same fashion as the arms of the above described anchors. Suitable limits screws (not shown) similar to the limit screws 29 of FIG. 2 are provided in the anchor of FIG. 6.

In one embodiment of the device illustrated in FIG. 6 there is 15 pounds compression in the spring 200 and 15 pounds compression in the spring 221 when the device is in the position of FIG. 6. In the position of FIG. 6 there is no external force exerted upwardly on the striker rod 226, and the striker rod 226 exerts no downward force on the blocking element 201. In other words, all of the force exerted on the element 201 of the device in the position of FIG. 6 is exerted by the spring 200 which exerts 15 pounds downward force on the member 212. When a pull is exerted upwardly on the rod 226 which is sufficient to bring the striker surface 216 against the anvil surface 215 in a relatively slow movement, approximately 7 to 8 more pounds compression is produced in the spring 223. However, the approximately 7 to 8 pounds compression is relieved in the spring 200 as it extends. Therefore, a total force on the anchor line of 15 pounds is necessary to move the striker surface 216 to the anvil surface 215.

Further upward movement of the striker element must be effected against the entire force of the spring 223 without the assistance of the spring 200 because the striker element begins to lift the blocking element 201. The embodiment of FIG. 6 has the same advantage as the embodiment of FIG. 5 in that the blocking element always has a spring acting to hold it in position unless the force on the anchor line becomes substantial in which event the pull on the flukes causes them to grip the blocking element and hold it in place by friction. On the other hand, it is not necessary to exert a very high force on the anchor line in order to move the striker element to the striking position. Therefore, the anchor can be tripped with a jerk on a relatively long anchor line.

Figure 7:
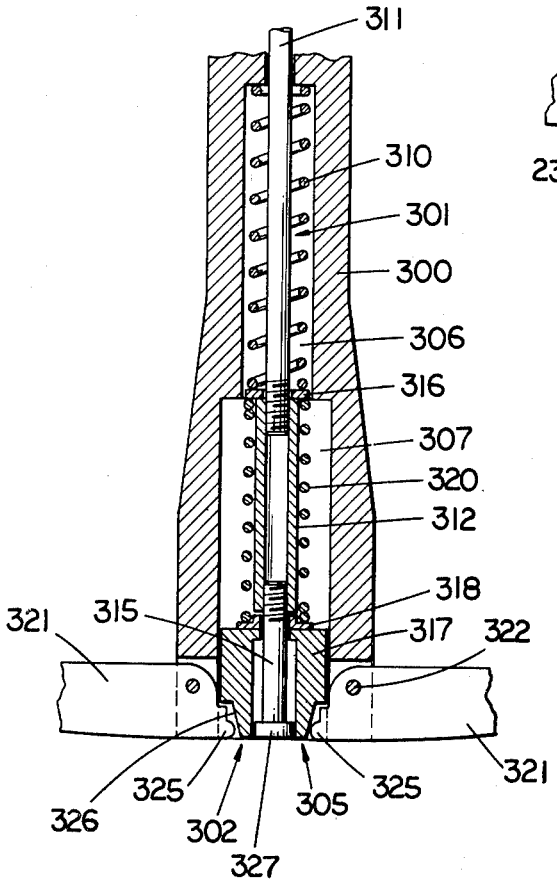
FIG. 7 is a view similar to FIG. 1 of still a further alternative embodiment of the invention.

Referring now to FIG. 7, a further embodiment of the invention is illustrated as including an elongated body 300, a striker element 301 and a blocking element 302. The body 300 has an indentation 305 which has a reduced diameter portion 306 and a larger diameter portion 307. Received within the reduced diameter portion 306 is a coiled spring 310 which acts between the body 300 and the striker element 301. The striker element 301 includes rod 311, nipple 312, striker member 315 and washer 316. Rod 311 is threadedly fixed to nipple 312 which is threadedly fixed to the striker member 315. The washer 316 is received on the rod 311 and held against the nipple 312 by the spring 310.

A flanged washer 318 forms a part of the blocking element and is received on the striker member 315 and is held in engagement with the blocking member 317 of the blocking element 302 by a coil spring 320 which acts between the washers 316 and 318. The flanged washer is sufficiently large to permit the striker member to slide freely relative to the washer and provides a seat to maintain the coil spring 320 coaxially located. The flukes or arms are pivotally mounted on the pins 322 to the body 300 as above described and have projecting portions 325 which engage the tapering surface 326 of the blocking member 317 as above described in connection with another embodiment.

In one embodiment of the invention the springs 310 and 320 when in the position of FIG. 7 each had a compression therein of 15 pounds. When a force is exerted on the rod 311 moving the striker head 327 almost into contact with the blocking member 317, the spring rate of the respective springs is such that shortening of spring 310 causes 7 to 8 additional pounds of force to built up in the spring; however, spring 320 is lengthened causing it to lose 7 to 8 pounds of force. The net effect is that the anchor line has approximately 15 pounds of force in it, i.e. the total force in spring 310 (22–23 pounds) minus the force in the spring 320. Further upward movement of the striker element must be effected against the entire force of spring 310 without the assistance of the spring 320 because the striker element begins to lift the blocking element 302. This embodiment has the same operational advantages as the embodiments of FIGS. 5 and 6 whereby the anchor can be tripped with a jerk on a relatively long anchor line, the anchor wil not trip when dragged across the ground, and the anchor will maintain a good hold during normal anchoring operation.

The anchor of FIGS. 1–4 has a groove 400 in the blocking element 25 thereof which receives the projection 39 of each of the arms 21 to lock the arms in the storage position of FIG. 4. In order to place the arms in the anchoring position of FIGS. 1 and 3 it is only necessary to pull on the arms and the spring 41 will move the blocking element to the blocking position of FIG. 1. If desired, this feature can be added to the embodiment of FIG. 6.

Figure 5B:
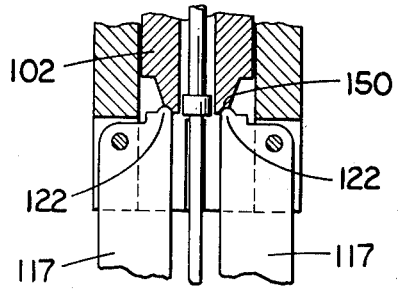
FIG. 5B is a section similar to FIG. 5 of an alternative embodiment of the present invention.

Referring to FIG. 5B there is illustrated an alternative form of the invention which is identical to the embodiment of FIG. 5 except that it also includes an arrangement for locking the flukes in a storage position such as that shown for the embodiment of FIG. 4. The embodiment of FIG. 5B includes an annular groove 150 which receives the portions 122 of the arms 117 to hold the arms in the storage position. In order to place the arms in the anchoring position (as shown for the embodiment of FIG. 5), it is only necessary to pull on the arms and the spring 100 will move the blocking element 102 to the blocking position.

Figure 8:
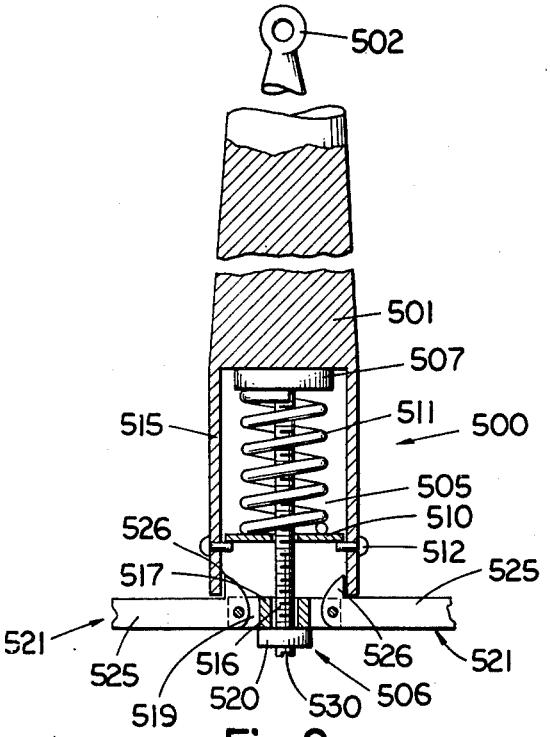
FIG. 8 is a view similar to FIG. 1 of still another alternative embodiment of the invention.

Referring now more particularly to FIG. 8, there is illustrated an anchor 500 which includes an elongated body 501 having an eyelet 502 at an upper end thereof for connection to an anchor line. At the lower end of the body 501 there is an identation 505 within which a bolt 506 is slidably received. The bolt 506 has a head 507 which has a diameter slightly smaller than the diameter of the indentation 505.

A washer 510 is also received in the indentation 505 and also has an outside diameter slightly smaller than the diameter of the indentation 505. The washer 510 has an internal diameter which receives for free sliding movement the bolt 506. Acting between the head 507 of the bolt and the washer 510 is a coiled compression spring 511. The washer 510 is limited against movement downwardly past the illustrated position by means of a plurality of inwardly projecting pins or screws 512 which extend through the wall 515 of the elongated body 501 into the indentation 505. The bolt 506 has a reduced diameter threaded portion 516 upon which is mounted for free movement an annular member 517. The nut 520 retains the annular member on the bolt 506. The annular member 517 has pivotally mounted thereon in slots 519 L-shaped flukes or arms 521 which have one portion 525 of the L-shape extending radially outwardly away from the body 501 and the other portion 526 of the L-shape projecting into the indentation 505. A screw driver slot 530 is provided in the bolt 506 for assisting in adjusting the position of the nut 520 on the bolt 506.

In operation, the anchor of FIG. 8 can only be tripped when the anchor line tension reaches a certain predetermined amount. Thus, if one of the arms 521 engages an obstacle when the anchor is being used, the anchor will operate to maintain an anchoring effect until such time as the force on the anchor line compresses the spring 511 causing the L-shaped anchor arms to move out of the indentation 505 and permitting the arms to pivot downwardly to a position wherein they are projecting downwardly. The arms will remain in that position until they are forceably returned to a position wherein the projecting portion 526 of the L-shaped arms can again project into the indentation 505 so that the device can move again to the position illustrated in FIG. 8.

Figure 9:
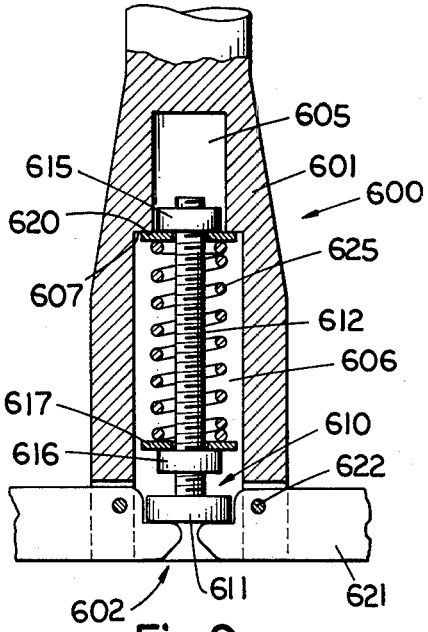
FIG. 9 is a view similar to FIG. 1 of still another alternative embodiment of the invention.
Figure 10:
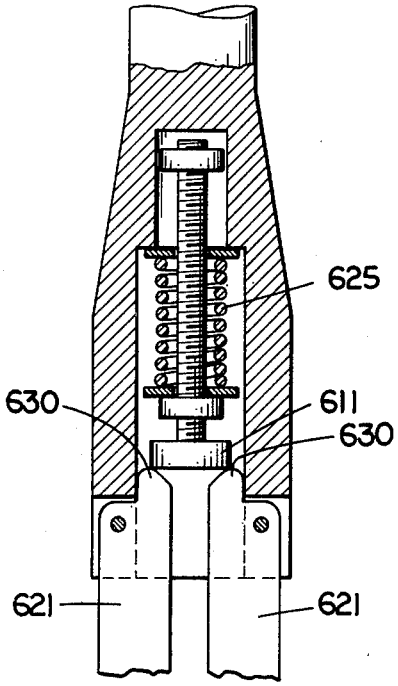
FIG. 10 is a view similar to FIG. 9 of the embodiment of FIG. 9 but showing the embodiment in a different operating position.
Figure 11:
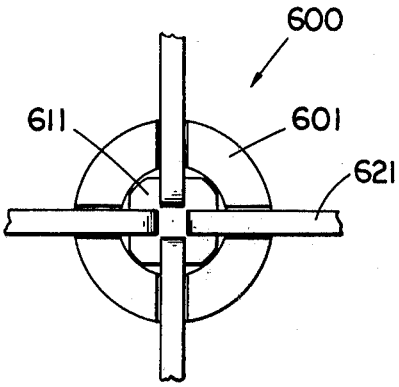
FIG. 11 is a bottom plan view of the structure of FIG. 9.

Referring now to FIGS. 9, 10 and 11, there is illustrated an anchor 600 which includes an elongated body 601 which has at its upper end (not shown) an eyelet identical to the eyelet 502 for connection to an anchor line. The lower end of the elongated body 600 has an indentation 602 therein which includes a reduced diameter portion 605, a larger diameter portion 606 and a shoulder 607 joining the larger diameter portion 606 and the reduced diameter portion 605. A bolt 610 is reciprocably received within the indentation 602. Bolt 610 has an enlarged head 611 and a threaded portion 612. The head 611 of the bolt is positioned in the mouth of the indentation 602 and the threaded portion 612 projects into the reduced diameter portion 605 of the indentation 602.

A pair of nuts 615 and 616 are threadedly received on the threaded portion. A pair of washers 617 and 620 are received on the threaded portion 612 between the nuts 615 and 616. Four arms or flukes 621 are pivotally mounted on the body 601 by pins 622 and in the anchoring position of FIG. 9 extend radially outwardly of the elongated body. A coiled compression spring 625 is received on the bolt 610 between the washers 617 and 620 and functions to urge one of the washers 620 into contact with the shoulder 607 and to urge both of the washers 620 and 617 into contact with the nuts 615 and 616 which yieldably positions the head 611 of the bolt in the mouth of the indentation 602. The spring 625 is yieldable by reason of the pressure of the arms to permit the bolt to move further into the reduced diameter portion 605 of the indentation and to permit the arms to pivot on the body to a position wherein the arms extend in the longitudinal direction of the body as illustrated in FIG. 10. The position of FIG. 10 is one in which the anchor can be placed for storage purposes. It will be noted that the spring 625 functions to hold the arm 621 in the position of FIG. 10 by engagement of the head 611 with the flat surfaces 630 on the arm 621.

In the case of the anchor of FIG. 8 as well as the anchor of FIGS. 9, 10 and 11, the amount of force necessary to trip the anchor can be adjusted. In the case of the anchor of FIG. 8, the position of the nut 520 can be adjusted on the threaded portion 516 of the bolt 506. In the case of the anchor of FIGS. 9, 10 and 11, the amount of force necessary to trip the anchor can be increased by rotating the nut 616 in such a direction as to move the washer 617 upwardly when in the position of FIG. 9, thus putting more compression into the spring 625. The amount of force necessary to trip the anchor can be reduced by moving the nut 616 downwardly from the position illustrated in FIG. 9.

Figure 12:
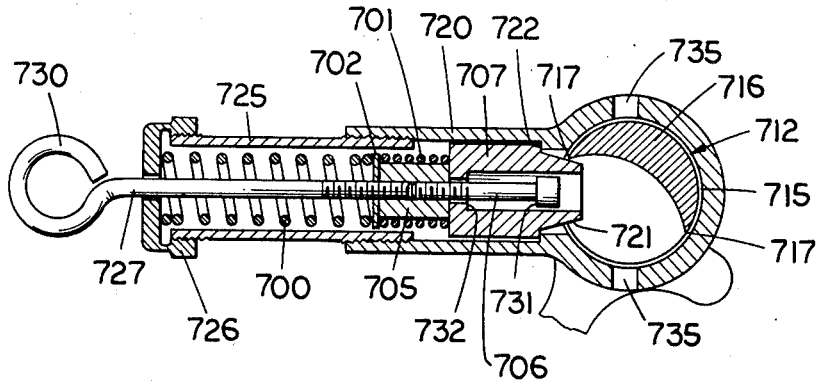
FIG. 12 is a section taken along the lines 12—12 of FIG. 13 of another alternative embodiment of the present invention.
Figure 13:
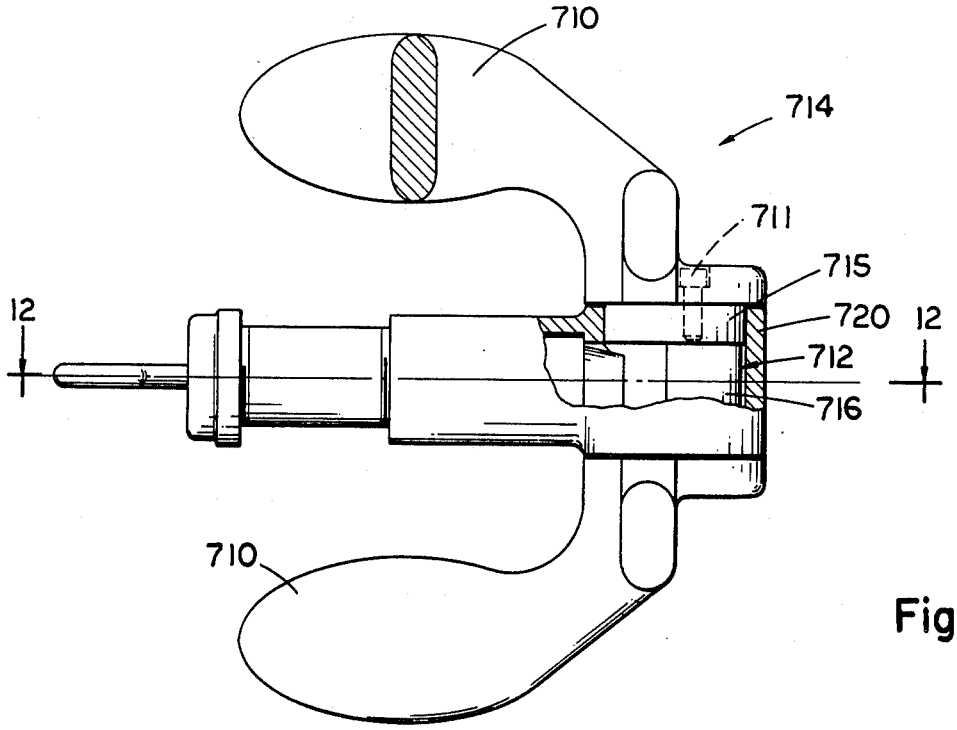
FIG. 13 is a front elevation of the structure of FIG. 12.

Referring more particularly to FIGS. 12 and 13, there is illustrated a Navy-type anchor which incorporates generally the same blocking element-striker element arrangement as is shown in FIG. 7. That is, the spring 700 corresponds to the spring 310, the spring 701 corresponds to the spring 320, the washer 702 to the washer 316, the connector 705 to the nipple 312, the striker member 706 to the striker member 315, and the blocking member 707 to the blocking member 317. If necessary, a flanged washer similar to the flanged washer 318 may also be provided to keep the coil spring 701 centered. The Navy-type anchor of FIG. 12 differs from the anchor of FIG. 7 in that the anchor comprises a fluke element 714 including flukes 710 which are fixed by bolts 711 (only one shown) to gripper bearing member 712. Gripper bearing member 712 includes outer bearing portions 715 and a reduced outer diameter half moon portion 716.

The outer diameter of the half moon portion 716 is reduced so that any burr formed on the edges 717 of the half moon portion will not cause friction and binding of the gripper bearing member 712 as it rotates in the body member 720. A burr can be formed on the edges 717 unless the half moon portion is constructed of hardened metal inasmuch as the edges engage the tapered portion 721 of the blocking element when the flukes are in the anchoring position of FIG. 12. The reduced outer diameter of the half moon portion therefore makes possible less expensive construction of the anchor.

The blocking member 707 is limited in its travel by the annular shoulder 722 on the body member 720. The anchor further includes externally threaded housing member 725 and a cap 726 which is threadedly mounted on the member 725 and has a central bore through which the rod 727 projects. An eyelet 730 on the end of the rod 727 is connectable to an anchor line. The rod 727 is threadedly connected to connector 705 which couples it to the striker member 706. The housing member 725 is threadedly connected to the body member 705.

In operation, the anchor may be used in the position of FIG. 13. When the flukes engage an obstacle, they move to the position of FIG. 12 wherein the half moon portion 716 engages the tapered portion 721. As in the embodiment of FIG. 7 the spring 701 has a compression in it which holds the blocking member 707 in the illustrated blocking position against the abutment 722. As long as a steady pull is exerted on the anchor line, the anchor will not trip because the edge 717 firmly engages the blocking member 707 holding it in blocking position. When it is desired to trip the anchor, the tension in the anchor line is first released and then a quick jerk on the line causes the striker surface 731 to hit anvil surface 732 driving the blocking member 707 out of blocking position. When the blocking member is out of blocking position the flukes rotate all the way around until they project rightwardly as viewed in FIG. 13 thus releasing the anchor.

Figure 14:
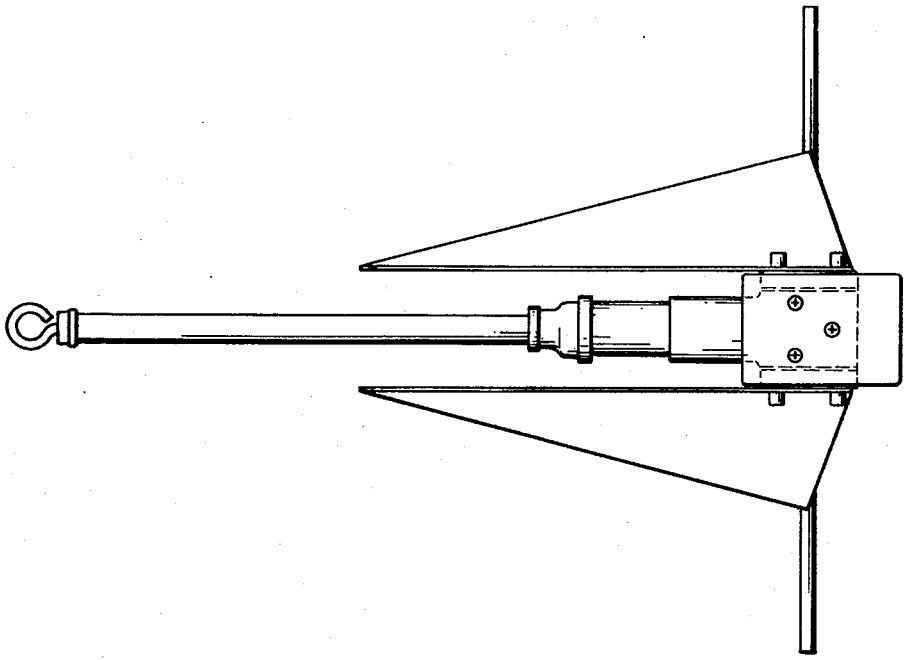
FIG. 14 is a side elevation of a further alternative embodiment of the present invention.
Figure 15:
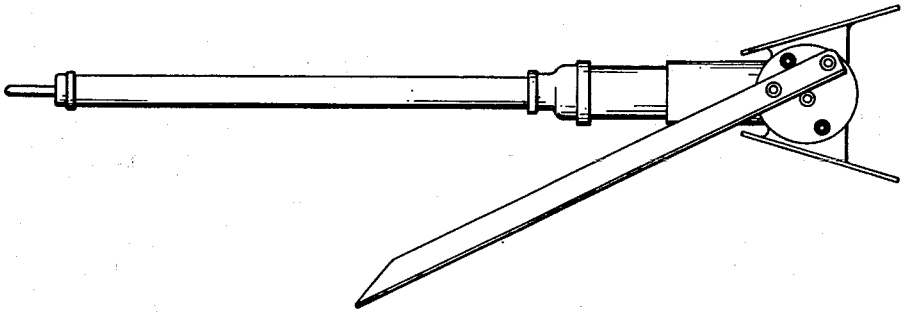
FIG. 15 is a front elevation of the structure of FIG. 14 showing it in a different operating position than FIG. 14.

The body member 720 has openings 735 therein to permit flow of water into and out of the body member 720 so that no hydraulic ram effect occurs blocking movement of the blocking member 707. The various spring forces and rates of springs 700 and 701 may vary; however, the examples given above in connection with FIG. 7 are also usable for FIGS. 12 and 13. FIGS. 14 and 15 show a Danforth type anchor having incorporated therein the same mechanism as is shown incorporated in the Navy-type anchor of FIGS. 12 and 13. The operation of the anchor of FIGS. 14 and 15 is the same as that of the anchor of FIGS. 12 and 13.

Figure 16:
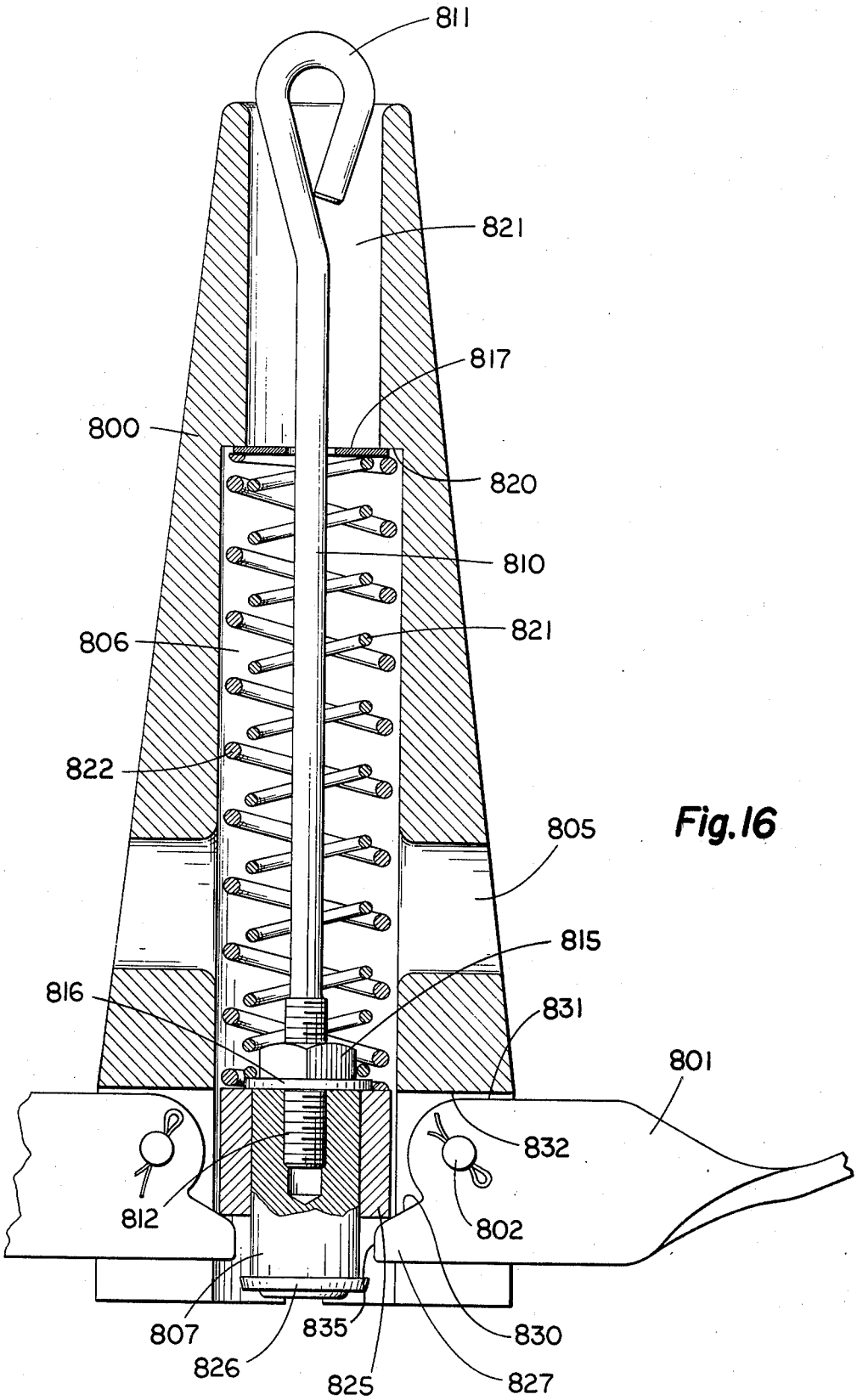
FIG. 16 is a sectional view similar to FIG. 1 of a preferred embodiment of the invention.

Referring to FIG. 16, a further preferred embodiment of the invention is shown which has the advantages of being easily releasable by merely jerking the anchor line and which is easily releasable even with a relatively long anchor line. The anchor includes an elongated body 800 having arms or flukes 801 (only one shown) pivotally mounted thereon by pins 802. The body has slots 805 similar to the slots 125 extending from the outside of the body to the hollow interior 806 to prevent a hydraulic ram effect. The embodiment of FIG. 16 differs from the above described embodiments in that there is no striker element. Instead, the blocking element 807 is connected directly to the anchor line through the rod 810 which has a loop 811 thereon for connection to the anchor line.

The rod 810 is externally threaded at 812, the blocking element 807 being threadedly connected to the rod thereby. A nut 815 is threadedly received on the threads 812 to fixedly secure the washer 816 to the blocking element. A further washer 817 is received in the hollow interior 806 in abutment with shoulder 820 joining the reduced diameter portion 821 to the remainder of the hollow interior 806. The washers 817 and 816 have a compression spring 821 received therebetween. A further compression spring 822 acts between the washer 817 and a sleeve 825 slidably received on the blocking element 807.

The blocking element 807 has a flange 826 on its lower end which provides one limit of travel of the sleeve 825, the other limit of travel being provided by the washer 816. The flange 826 also serves to maintain the blocking element in blocking position, even though an extremely high force is exerted on the fluke 801 by engagement of the fluke with the ground or rocks or other objects in anchoring relation. When the flukes are not hooked onto objects in anchoring relation, they are held generally in the illustrated position by the spring 822 acting through the sleeve 825 against the tapered projection 827 of the fluke 801.

In one specific embodiment of the invention the amount of force necessary to pivot the fluke inward to contact the blocking element 807 was 16 lbs. In other words, with the flukes hooked on an object, it is necessary to exert a force of 16 lbs. on the loop 811 in an upward direction as viewed in FIG. 16 to cause the fluke to touch the blocking element. This 16 lbs. of force is produced by both springs 821 and 822. When the fluke is not engaged in anchoring relation, this 16 lbs. of force in both springs will cause the surfaces 831 on the flukes 801 and the surfaces 832 on the body 800 to engage thus limiting further upward pivoting of the fluke. The most downward position of the blocking element is determined by the engagement of the washer 816 with the sleeve 825 when the sleeve is also in its most downward position. The spring 821 with its compression force therein yieldably holds the blocking element downwardly with the washer 816 in engagement with the sleeve 825. The compression force in the spring 821 is such that 26 lbs. of pull on the loop 811 in an upward direction is necessary to cause the flange 826 to contact the sleeve while the body is held in the hand with no force on the flukes except the force of spring 822.

Assume now that the loop 811 of the anchor is secured to an anchor line and the fluke 801 becomes hooked onto an object in anchoring relation. Assume that the wind or waves tend to move the watercraft. Force will be exerted through the anchor line and anchor and pin 802 tending to raise the arm (as viewed in FIG. 16). The object engaged by the fluke will produce a downward force on the outer end portion of the fluke tending to cause it to rotate about the axis of the pin 802. If the torque so produced on the fluke is greater than the torque produced on the fluke by the springs 821 and 822, the surface 835 of projection 827 will move against the blocking element 807. Even extreme amounts of force exerted by the anchor line on the blocking element tending to move it upwardly will not dislodge the blocking element from the projection 827 because of the frictional force between the blocking element and projection and because the flange 826 will engage the projection.

Assuming now it is desired to release the anchor from a snagged situation, tension on the anchor rope is first released. Then the anchor line is given a quick jerk. The release of rope tension causes the projection 827 to move away from the blocking element and out of the path of the flange 826. The quick jerk causes the blocking element to be moved past the projection 827 because the inertia of the body 800 is sufficient to hold it in position as the blocking element moves. The flukes will momentarily move downward to let the anchor slide out of the snag and then will reset instantly into generally the position of FIG. 16 under the action of the springs 821 and 822. If desired, the embodiment of FIG. 16 may be provided with locking grooves such as are shown in FIG. 5B.

It can be seen from the above description that the present invention provides an improved anchor which will hold a watercraft in place under normal boat action but which is easily releasably by merely jerking the anchor line, this feature being provided by the anchors shown in FIGS. 1–7, 12, 13, 14, 15 and 16. It will also be evident that the present invention provides an anchor which is releasable, even though the anchor has a relatively long anchor line, this result being achieved by the anchors illustrated in FIGS. 5, 6, 7, 12, 13, 14, 15 and 16. It will also be clear that the present invention provides an anchor which is releasable at a certain anchor line tension which is adjustable with particular reference to the anchors of FIGS. 8, 9, 10 and 11.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A releasable anchor comprising:

a body;

an arm pivotally mounted on said body, said arm including a gripping surface, said arm being pivotable between an outwardly-extending position and a retracted position;

a blocking element connected to said body, said blocking element having a blocking position and a release position, said blocking element being movable between the blocking and release positions;

said arm having a first position in which said blocking element is in the blocking position and the gripping surface of said arm frictionally engages said blocking element and prevents movement of said blocking element from the blocking position to the release position, said arm in the first position being intermediate the outwardly-extending position and the retracted position;

biasing means for biasing said arm to the outwardly-extending position;

said arm having a second position corresponding to the outwardly-extending position, said biasing means being operable to move said arm from the first position to the second position, said blocking element being movable from the blocking position to the release position when said arm is in the second position; and release means for moving said blocking element from the blocking position to the release position, said release means including means for connecting said blocking element to an anchor line, said arm having a third position corresponding to the retracted position, said arm being movable from the second position to the third position when said blocking element is in the release position.

2. The anchor of claim 1 wherein said biasing means comprises a sleeve received on said blocking element and spring means acting between said body and said sleeve, said sleeve engaging said arm to hold it out of said first position.

3. The anchor of claim 2 wherein said blocking element has a flange thereon, said arm being adapted to engage said flange to stop movement of said blocking element out of the blocking position when said arm is in the first position.

4. The anchor of claim 3 additionally comprising a second spring acting between said body and said blocking element and yieldably retaining said blocking element in said blocking position.

5. The anchor of claim 4 wherein said second spring is sufficiently weak and said body has sufficient inertia to permit said blocking element to move out of the blocking position when said arm is in the second position and a sharp jerk is exerted on the anchor line.

6. The anchor of claim 1 and further comprising:

a second arm pivotally mounted on said body, said second arm including a gripping surface, said second arm being pivotable between an outwardly-extending position and a retracted position, said arm having a first position in which said blocking element is in the blocking position and the gripping surface of said second arm frictionally engages said blocking element and prevents movement of said blocking element from the blocking position to the release position, said second arm in the first position being intermediate the outwardly-extending position and the retracted position;

said biasing means being for biasing both of the first and second arms to the respective, outwardly-extending positions, said second arm having a second position corresponding to the outwardly-extending position, said biasing means being operable to move said second arm from the first position to the second position, said blocking element being movable from the blocking position to the release position when said second arm is in the second position; and said second arm having a third position corresponding to the retracted position of said second arm, said second arm being movable from the second position to the third position when said blocking element is in the release position.

7. The anchor of claim 1 in which said blocking element is cylindrical.

8. The anchor of claim 1 in which said means for connection said blocking element to an anchor line includes a shaft connected at one end to said blocking element, the shaft being received within a longitudinal bore in said body.

9. The anchor of claim 1 and further comprising an anchor line connected to said blocking element.

* * * * *